US005454983A

United States Patent [19]

Michael et al.

[11] Patent Number: 5,454,983

[45] Date of Patent: Oct. 3, 1995

[54] LIQUID HARD SURFACE DETERGENT COMPOSITIONS CONTAINING ZWITTERIONIC AND CATIONIC DETERGENT SURFACTANTS AND MONOETHANOLAMINE AND/OR BETA-AMINOALKANOL

[75] Inventors: Daniel W. Michael; David C. Underwood; George E. Dostie; Paul Stiros, all of Cincinnati, Ohio

[73] Assignee: The Proctor & Gamble Company, Cincinnati, Ohio

[21] Appl. No.: 113,559

[22] Filed: Aug. 27, 1993

Related U.S. Application Data

[63] Continuation of Ser. No. 824,649, Jan. 23, 1992, abandoned.

[51] Int. Cl.[6] ..... C11D 1/62; C11D 1/90; C11D 1/92; C11D 3/30

[52] U.S. Cl. ..... 252/545; 252/546; 252/547; 252/548; 252/153; 252/158; 252/173; 252/174.11; 252/DIG. 10; 252/DIG. 14

[58] Field of Search ..... 252/548, 545, 252/546, 153, 158, 174.11, DIG. 10, DIG. 14, 173, 547

[56] References Cited

U.S. PATENT DOCUMENTS

| | | | |
|---|---|---|---|
| 3,280,179 | 10/1966 | Ernst | 260/501 |
| 3,309,321 | 3/1967 | McMaster | 252/152 |
| 3,649,569 | 3/1972 | McCarty | 252/543 |
| 3,696,043 | 10/1972 | Labarge et al. | 252/153 |
| 3,706,672 | 12/1972 | Martin et al. | 252/156 |
| 3,755,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |

(List continued on next page.)

FOREIGN PATENT DOCUMENTS

| | | | |
|---|---|---|---|
| 88168 | 9/1982 | Australia | C11D 10/04 |
| 706408 | 3/1965 | Canada | 260/309.6 |
| 706409 | 3/1965 | Canada | 260/309.6 |
| 0004755 | 10/1979 | European Pat. Off. | C11D 1/94 |
| 0024031A1 | 2/1981 | European Pat. Off. | C11D 1/90 |
| 0040882A2 | 12/1981 | European Pat. Off. | C11D 3/16 |
| 0067635A2 | 12/1982 | European Pat. Off. | A61K 7/08 |
| 0106266A2 | 4/1984 | European Pat. Off. | C11D 3/43 |
| 0117135A2 | 8/1984 | European Pat. Off. | C11D 3/37 |
| 0157443 | 10/1985 | European Pat. Off. | C11D 1/83 |
| 0181212 | 5/1986 | European Pat. Off. | C11D 1/94 |

(List continued on next page.)

OTHER PUBLICATIONS

N. Parris et al., "Soap Based Detergent Formulations. V. Amphoteric Lime Soap Dispersing Agents," JAOCS, 50(1973) pp. 509–512.

W. R. Noble et al., "Soap–Based Detergent Formulations: X. Nature of Detergent Deposits," JAOCS, 52(1975) pp. 1–4.

N. Parris et al., "Soap–Based Detergent Formulations: XII. Alternate Syntheses of Surface Active Sulfobetaines," JAOCS, 53(1976) pp. 60–63.

F. D. Smith et al., "Soap–Based Detergent Formulations: XV. Amino Esters of alpha–sulfo Fatty Acids," JAOCS, 53(1976) pp. 69–72.

(List continued on next page.)

*Primary Examiner*—Paul Lieberman
*Assistant Examiner*—Erin M. Harriman
*Attorney, Agent, or Firm*—Robert B. Aylor

[57] ABSTRACT

Aqueous, liquid hard surface detergent compositions contain zwitterionic and cationic detergent surfactants and monoethanolamine and/or other specific beta-aminoalkanols as solvents and/or buffers for improved spotting/filming and good cleaning. Some formulas do not contain large amounts of builders and are suitable for general purpose cleaning including cleaning of glass. Other formulas are concentrated and contain chelating agents (detergent builders) to improve stability of more dilute compositions prepared from the concentrated compositions. Some of the formulas, both dilute and concentrated, possess disinfectant properties.

29 Claims, No Drawings

U.S. PATENT DOCUMENTS

| | | | |
|---|---|---|---|
| 3,876,563 | 4/1975 | Collins | 252/545 |
| 3,928,065 | 12/1975 | Savino | 134/7 |
| 3,950,417 | 4/1976 | Verdicchio et al. | 252/545 |
| 3,962,418 | 6/1976 | Birkofer | 424/70 |
| 4,110,263 | 8/1978 | Lindemann et al. | 252/545 |
| 4,122,043 | 10/1978 | Kersnar et al. | 252/527 |
| 4,145,184 | 3/1979 | Brain et al. | 8/137 |
| 4,148,762 | 4/1979 | Koch et al. | 252/544 |
| 4,152,272 | 5/1979 | Young | 252/8.8 |
| 4,158,644 | 6/1979 | Hammerel | 252/547 |
| 4,181,634 | 1/1980 | Kennedy et al. | 252/545 |
| 4,186,113 | 1/1980 | Verdicchio et al. | 252/526 |
| 4,209,417 | 6/1980 | Whyte | 252/174.11 |
| 4,233,192 | 11/1980 | Lindemann et al. | 252/545 |
| 4,257,907 | 3/1981 | Langguth et al. | 252/106 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,287,080 | 9/1981 | Siklosi | 252/104 |
| 4,299,739 | 11/1981 | Esposito et al. | 252/545 |
| 4,329,334 | 5/1982 | Su et al. | 424/70 |
| 4,329,335 | 5/1982 | Su et al. | 424/70 |
| 4,372,869 | 2/1983 | Lindemann et al. | 252/174.16 |
| 4,414,128 | 11/1983 | Goffinet | 252/111 |
| 4,420,484 | 12/1983 | Gorman et al. | 424/326 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,455,250 | 6/1984 | Frazier | 252/106 |
| 4,477,365 | 10/1984 | Verboom et al. | 252/156 |
| 4,485,029 | 11/1984 | Kato et al. | 252/106 |
| 4,486,328 | 12/1984 | Knott et al. | 252/117 |
| 4,529,588 | 7/1985 | Smith et al. | 424/70 |
| 4,554,098 | 11/1985 | Klisch et al. | 252/547 |
| 4,654,207 | 3/1987 | Preston | 424/70 |
| 4,673,523 | 6/1987 | Smith et al. | 252/91 |
| 4,683,008 | 7/1987 | Betts | 134/27 |
| 4,689,168 | 8/1987 | Requejo | 252/139 |
| 4,690,779 | 9/1987 | Baker et al. | 252/546 |
| 4,692,277 | 9/1987 | Siklosi | 252/558 |
| 4,769,172 | 9/1988 | Siklosi | 252/153 |
| 4,772,424 | 9/1988 | Greeb | 252/546 |
| 4,784,786 | 11/1988 | Smith et al. | 252/91 |
| 4,913,841 | 4/1990 | Zeman | 252/352 |
| 4,921,629 | 5/1990 | Malihi et al. | 252/170 |
| 4,983,317 | 6/1991 | Requejo et al. | 252/174.24 |
| 5,015,412 | 5/1991 | Zeman | 252/311 |
| 5,061,393 | 10/1991 | Linares et al. | 252/143 |
| 5,108,660 | 4/1992 | Michael | 252/545 |
| 5,290,472 | 3/1994 | Michael | 252/170 |
| 5,336,445 | 8/1994 | Michael et al. | 252/548 |
| 5,342,549 | 8/1994 | Michael | 252/546 |
| 5,362,422 | 11/1994 | Masters | 252/544 |

FOREIGN PATENT DOCUMENTS

| | | | |
|---|---|---|---|
| 3,928,251 | 12/1975 | Bolich, Jr. et al. | 252/545 |
| 3,935,130 | 1/1976 | Hirano et al. | 252/542 |
| 0205626A1 | 12/1986 | European Pat. Off. | C07C 143/14 |
| 0338850 | 10/1989 | European Pat. Off. | A61K 7/075 |
| 0373851A2 | 6/1990 | European Pat. Off. | C11D 1/94 |
| 0408174A1 | 1/1991 | European Pat. Off. | A61K 7/16 |
| 274332A3 | 12/1989 | Germany | C07C 143/15 |
| 275046A1 | 1/1990 | Germany | C07C 207/08 |
| 48-60706 | 8/1973 | Japan . | |
| 59-189197 | 10/1984 | Japan | C11D 1/94 |
| 60-141797 | 7/1985 | Japan | C11D 1/94 |
| 60-161498 | 8/1985 | Japan | C11D 1/94 |
| 60-195200 | 10/1985 | Japan | C11D 1/94 |
| 61-014296 | 1/1986 | Japan | C11D 3/14 |
| 61-014298 | 1/1986 | Japan | C11D 3/43 |
| 61-009500 | 1/1986 | Japan | C11D 1/88 |
| 62-257992 | 11/1987 | Japan | C11D 3/60 |
| 62-252499 | 11/1987 | Japan | C11D 3/60 |
| 63-012333 | 1/1988 | Japan | B01F 17/16 |
| 01092298 | 4/1989 | Japan | C11D 1/88 |
| 01135898 | 5/1989 | Japan | A61K 7/7 |
| 01153796 | 6/1989 | Japan | A61K 7/7 |
| 01221496 | 9/1989 | Japan | C11D 1/2 |
| 01221497 | 9/1989 | Japan | C11D 1/62 |
| 02269200 | 2/1990 | Japan | C11D 1/94 |
| 02155996 | 6/1990 | Japan | C11D 10/04 |
| 02145697 | 6/1990 | Japan | C11D 1/92 |
| 02296899 | 12/1990 | Japan | A61K 7/7 |
| 03115495 | 5/1991 | Japan | C11D 1/10 |
| 03111494 | 5/1991 | Japan | C11D 1/94 |
| 03163052 | 7/1991 | Japan | C07C 233/47 |
| 03153797 | 7/1991 | Japan | C11D 1/88 |
| 03215410 | 9/1991 | Japan | A61K 7/7 |
| 03258900 | 11/1991 | Japan | A61K 7/7 |
| 84944A | 10/1984 | Romania | A61K 7/06 |
| 1544563 | 4/1979 | United Kingdom | C11D 1/94 |
| 2193505 | 2/1988 | United Kingdom | C11D 3/33 |
| WO91/09104 | 6/1991 | WIPO | C11D 7/32 |
| WO91/13610 | 9/1991 | WIPO | A61K 7/50 |
| WO91/15192 | 10/1991 | WIPO | A61K 7/50 |

OTHER PUBLICATIONS

Parris et al., "Soap–Based Detergent Formulations: XVIII. Effect of Structure Variations on Surface–Active Properties of Sulfur Containing Amphoteric Surfactants," JAOCS, 53(1976) pp. 97–100.

J. K. Weil et al., "Soap–Based Detergent Formulations: XX. The Physical and Chemical Nature of Lime Soap Dispersions," JAOCS, 53(1976) pp. 757–761.

J. K. Weil et al., "The Mutual Solubilization of Soap and Lime Soap Dispersing Agents," JAOCS, 54(1977) pp. 1–3.

T. J. Micich et al., "Soap–Based Detergent Formulations: XIX. Amphoteric Alkylsuccinamide Derivatives as Lime Soap Dispersants," JAOCS, 54(1977) pp. 91–94.

T. J. Micich et al., "Soap–Based Detergent Formulations: XXII. Sulfobetaine Derivatives of N–Alkylglutaramides and Adipamides," JAOCS, 54(1977) pp. 264–266.

N. Parris et al., "Soap Based Detergent Formulation: XXIV. Sulfobetaine Derivatives of Fatty Amides," JAOCS, 54(1977), pp. 294–296.

J. K. Weil et al., "Surface Active Properties of Combinations of Soap and Lime Soap Dispersing Agents," JAOCS, 54(1976) pp. 339–342.

J. M. Kaminski et al., "Soap–Based Detergent Formulations: XXIII. Synthesis of p–Sulfobenzyl Ammonium Inner Salts and Structural Correlation with Analogous Amphoterics," JAOCS, 54(1977) pp. 516–520.

F. D. Smith et al., "Soap–based Detergent Formulations: XXI. Amphoteric Derivatives of Fatty Amides of Aminoethylethanolamine," JAOCS, 55(1978), pp. 741–744.

J. M. Kaminski et al., "Soap–Based Detergent Formulations: XXV. Synthesis and Surface Active Properties of Higher Molecular Weight Betaine Lime Soap Dispersants," JAOCS, 56(1979) pp. 771–774.

W. M. Linfield, "Soap and Lime Soap Dispersants," JAOCS, 55(1978), pp. 87–92.

W. R. Noble et al., "Soap–based Detergent Formulations: XXVI. Hard Water Detergency of Soap–lime Soap Dispersant Combinations, with Builders and Inorganic Salts," JAOCS, 57(1980), pp. 368–372.

J. G. Weers et al., "Effect of the intramolecular charge separation distance on the solution properties of betaines and sulfobetaines," Langmuir, 1991, vol. 7(5), pp. 854–867. (Abstract only).

T. Takeda et al., "Synthesis and properties of a, w–bis(amidopropylhydroxy–sulfobetaine)–type amphoteric surfactants," Yukagaku, 1990, vol. 39(8), pp. 576–579. (Abstract only).

Chem. Abstract 115(14):138653q—V. Allikama, "Highly efficient reversed–phase HPLC studies of amphoteric and cationic amido group–containing surfactants," Eesti Tead. Akad. Toim., Keem 1991, 40(1), 67–72. no month available.

Chem. Abstract 102(22):190818t—P. Busch et al., "Hair–conditioning effect of Guar hydroxypropyl–trimethylammonium chloride, Part I.", Parfuem. Kosmet. 1984 65(11), 692, 694–6, 698.

Chem. Abstract 102(22):190819u—P. Busch et al., "Hair–conditioning effect of Guar hydroxypropyl–trimethylammonium chloride. Part 2.", Parfuem. Kosmet. 1984 65(12), 756, 758–60.

Chem. Abstract 108(1):5366g—C. A. Bunton, "Micellar effects on nucleophilicity," Adv. Chem. Ser. 1987, 215(Nucleophilicity), 425–41.

Chem. Abstract 115(6):56929v–CTFA, Inc., "Final report on the safety assessment of cocamidopropyl betaine," J. Am. Coll. Toxicol. 1991, 10(1). 33–52.

LIQUID HARD SURFACE DETERGENT COMPOSITIONS CONTAINING ZWITTERIONIC AND CATIONIC DETERGENT SURFACTANTS AND MONOETHANOLAMINE AND/OR BETA-AMINOALKANOL

This is a continuation of application Ser. No. 07/824,649, filed on Jan. 23, 1992, now abandoned.

BACKGROUND OF THE INVENTION

1. Field of the Invention

This invention pertains to liquid detergent compositions for use in cleaning hard surfaces, and especially to disinfectant and/or concentrated compositions. Such compositions typically contain detergent surfactants, solvents, builders, etc.

2. Description of Related Art

The use of solvents and organic water-soluble synthetic detergents at low levels for cleaning glass are known.

Similar compositions are disclosed and claimed in copending U.S. patent application Ser. No. 07/818,499, filed Jan. 8, 1992, said patent application being a file wrapper continuation of U.S. patent application Ser. No. 07/628,067, filed Dec. 21, 1990, by Daniel W. Michael, entitled LIQUID HARD SURFACE DETERGENT COMPOSITIONS CONTAINING ZWITTERIONIC AND DETERGENT SURFACTANTS AND MONOETHANOLAMINE AND/OR BETA-AMINOALKANOL.

General purpose household cleaning compositions for hard surfaces such as metal, glass, ceramic, plastic and linoleum surfaces, are commercially available in both powdered and liquid form. Liquid detergent compositions are disclosed in Australian Pat. Application 82/88168, filed Sep. 9, 1982, by The Procter & Gamble Company; U.K. Pat. Application GB 2,166,153A, filed Oct. 24, 1985, by The Procter & Gamble Company; and U.K. Pat. Application GB 2,160,887A, filed Jun. 19, 1985, by Bristol-Myers Company, all of said published applications being incorporated herein by reference. These liquid detergent compositions comprise certain organic solvents, surfactant, and optional builder and/or abrasive. The prior art, however, fails to teach, or recognize, the advantage of the specific surfactants and organic solvents/buffers disclosed hereinafter, in liquid hard surface cleaner formulations.

Liquid cleaning compositions have the great advantage that they can be applied to hard surfaces in neat or concentrated form, where a relatively high level of surfactant material and organic solvent is delivered directly to the soil. Moreover, it is a rather more straightforward task to dilute high concentrations of surfactant from a liquid rather than a granular composition.

Liquid cleaning compositions, and especially compositions prepared for cleaning glass, should have good spotting/filming properties.

An object of the present invention is to provide detergent compositions which provide good glass cleaning without excessive filming and/or streaking.

SUMMARY OF THE INVENTION

The present invention relates to an aqueous, liquid, hard surface detergent composition comprising: (a) zwitterionic detergent surfactant, containing a cationic group, preferably a quaternary ammonium group, and an anionic group, preferably a carboxylate, sulfonate, or sulfate group, more preferably a sulfonate group; (b) cationic detergent surfactant having a single long, or, less preferably, two shorter, hydrophobic groups, preferably a single long alkyl group, and more preferably cationic detergent surfactant having disinfectant properties; (c) monoethanolamine, beta-aminoalkanol which contains from about three to about six carbon atoms, or mixtures thereof, preferably monoethanolamine; (d) optional, but highly desirably, detergent builder, especially in concentrated compositions suitable for dilution; and the balance being (e) aqueous solvent system and, optionally, minor ingredients. The composition preferably does not contain anionic detergent surfactant or appreciable amounts of materials, like crystallizable salts, etc., that deposit on the surface being cleaned and cause unacceptable spotting/filming. The compositions can be formulated at usage concentrations, or as concentrates, and can be packaged in a container having means for creating a spray to make application to hard surfaces more convenient.

All percentages, parts, and ratios herein are "by weight" unless otherwise stated.

DETAILED DESCRIPTION OF THE INVENTION

In accordance with the present invention, it has been found that superior aqueous liquid detergent compositions for cleaning shiny surfaces such as glass contain zwitterionic detergent surfactant (containing both cationic and anionic groups in substantially equivalent proportions so as to be electrically neutral at the pH of use, typically at least about 9.5, preferably at least about 10), cationic detergent surfactant, and monoethanolamine and/or certain beta-aminoalkanol compounds.

(a) The Zwitterionic Detergent Surfactant

The aqueous, liquid hard surface detergent compositions (cleaners) herein contain from about 0.001% to about 15% of suitable zwitterionic detergent surfactant containing a cationic group, preferably a quaternary ammonium group, and an anionic group, preferably carboxylate, sulfate and/or sulfonate group, more preferably sulfonate. Successively more preferred ranges of zwitterionic detergent surfactant inclusion are from about 0.02% to about 10% of surfactant, and from about 0.1% to about 5% of surfactant. For concentrated detergent compositions, suitable for dilution, the preferred ranges are from about 0.2% to about 10%, preferably from about 0.3% to about 5%.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^3—[C(O)—N(R^4)—(CR^5{}_2)_n]_mN(R^6)_2{}^{(+)}—(CR^5{}_2)_p—Y^{(-)}$$

wherein each y is preferably a carboxylate (COO—) or sulfonate ($SO_3^-$) group, preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups; wherein ($R^6$) is like $R^4$ except preferably not hydrogen; wherein m is 0 or 1; and wherein each n and p are a number from 1 to about 4, preferably from 2 to about 3, more preferably about 3; there being no more than about one hydroxy group in any ($CR^5_2$) moiety, and more preferably only one $R^5$ group is a hydroxy group. The $R^3$ groups can be branched and/or unsaturated, and such structures can provide spotting/filming benefits, even when used as part of a mixture with straight chain alkyl $R^3$ groups. The $R^4$ groups can also be connected to form ring structures. Preferred hydrocarbyl amidoalkylene sulfobetaine (HASB) detergent surfactants wherein m=1 and y is a sulfonate group provide superior grease soil removal and/or filming/streaking and/or "anti-fogging" and/or perfume solubilization properties. Such hydrocarbylamidoalkylene betaines and, especially, hydrocarbylamidoalkylene sulfobetaines are excellent for use in hard surface cleaning detergent compositions, especially those formulated for use on both glass and hard-to-remove soils. They are even better when used with monoethanolamine and/or specific beta-amino alkanol as disclosed herein. A more preferred specific detergent surfactant is a $C_{10-14}$ fatty acyl amidopropylene-(hydroxypropylene)sulfobetaine, e.g., the detergent surfactant available from the Sherex Company as a 40% active product under the trade name "Varion CAS Sulfobetaine."

The level of zwitterionic detergent surfactant in the composition is dependent on the eventual level of dilution to make the wash solution. For glass cleaning, the composition, when used full strength, or wash solution containing the composition, should contain from about 0.02% to about 1%, preferably from about 0.05% to about 0.5%, more preferably from about 0.1% to about 0.25%, of detergent surfactant. For removal of difficult to remove soils like grease, the level can, and should be, higher, typically from about 0.1% to about 10%, preferably from about 0.25% to about 2%. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed 1 listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

(b) Cationic Detergent Surfactants

In general, cationic detergent surfactants useful herein contain a hydrophobic group, (or, less preferably, two hydrophobic groups,if they are shorter, e.g., from about 8 to about 10 carbon atoms), typically containing an alkyl group in the $C_8$–$C_{18}$ range, and, optionally, one or more groups such as ether or amido, preferably amido groups which interrupt the hydrophobic group. For disinfectancy, the alkyl group typically contains from about 8 to about 18 carbons, preferably from about 12 to about 18 carbons. Also, for optimum spotting/filming, the alkyl chain contains from about 12 to about 18 carbon atoms. The remaining groups are typically short chain alkyl, e.g., from about one to about four carbon atoms, e.g., methyl, or ethyl, or aromatic, e.g., benzyl, and/or $C_1$–$C_4$ alkyl benzyl groups. Two of the short groups can be replaced by a single group that is attached to the nitrogen atom at two locations on the group to form ring structures such as pyridinium or morpholinium structures.

Preferred disinfecting cationic detergent surfactants are: $C_{12-18}$ alkyl benzyl dimethyl ammonium chloride; $C_{12-14}$ alkyl dimethyl ethylbenzyl ammonium chloride; di-$C_{8-10}$ alkyl dimethyl ammonium chloride; and mixtures thereof.

The cationic detergent surfactants, and especially the disinfectant cationic detergent surfactants, are used at levels of from about 0.02% to about 0.4%, preferably from about 0.04% to about 0.25% in single strength products, and from about 0.1% to about 2%, preferably from about 0.7% to about 1.5% in concentrated compositions that are typically diluted.

It has been found that the combination of the zwitterionic and cationic detergent surfactants is surprisingly good for spotting/filming, as compared to similar compositions containing an anionic detergent surfactant or a nonionic detergent surfactant in place of the cationic detergent surfactant. The presence of the cationic detergent surfactant improves the ability of the composition to contain perfume, especially perfumes containing natural oils, or components thereof that are difficult to solubilize, without separation and/or opacification, and also functions as a hydrotrope in the concentrated compositions. Cationic surfactants cause less spotting/filming than anionic detergents such as alkyl sulfates and alkyl benzene sulfonates, or nonionic detergent surfactants, when incorporated in the compositions. In addition, when the cationic detergent surfactant has disinfectant properties, it provides an additional benefit.

(c) Monoethanolamine and/or Beta-aminoalkanol

Monoethanolamine and/or beta-aminoalkanol compounds serve primarily as solvents when the pH is above about 10.0, and especially above about 10.7. They also provide alkaline buffering capacity during use. However, the most unique contribution they make is to improve the spotting/filming properties of hard surface cleaning compositions containing the combination of zwitterionic and cationic detergent surfactant, whereas they do not provide any substantial improvement in spotting/filming when used with conventional anionic or ethoxylated nonionic detergent surfactants. The reason for the improvement is not known. It is not simply a pH effect, since the improvement is not seen with conventional alkalinity sources. Other similar materials that are solvents do not provide the same benefit and the effect can be different depending upon the other materials present. When perfumes that have a high percentage of terpenes are incorporated, the benefit is greater for the beta-alkanolamines, and they are often preferred, whereas the monoethanolamine is usually preferred.

Monoethanolamine and/or beta-alkanolamine are used at a level of from about 0.05% to about 10%, preferably from about 0.2% to about 5%. For dilute compositions they are typically present at a level of from about 0.05% to about 2%, preferably from about 0.1% to about 1.0%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

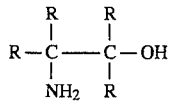

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

The beta-aminoalkanols are surprisingly better than, e.g., monoethanolamine for hard surface detergent compositions that contain perfume ingredients like terpenes and similar materials. However, normally the monoethanolamine is preferred for its effect in improving the spotting/filming performance of compositions containing zwitterionic detergent surfactant. The improvement in spotting/filming of hard surfaces that is achieved by including the monoethanolamine and/or beta-aminoalkanol was totally unexpected.

Good spotting/filming, i.e., minimal, or no, spotting/filming, is especially important for cleaning of, e.g., window glass or mirrors where vision is affected and for dishes and ceramic surfaces where spots are aesthetically undesirable. Beta-aminoalkanols provide superior cleaning of hard-to-remove greasy soils and superior product stability, especially under high temperature conditions, when used in hard surface cleaning compositions, especially those containing the zwitterionic detergent surfactants.

Beta-aminoalkanols, and especially the preferred 2-amino-2-methylpropanol, are surprisingly volatile from cleaned surfaces considering their relatively high molecular weights.

In addition to, or in place of, the monoethanolamine and/or beta-aminoalkanol, one can use 1-amino-2-propanol and/or 3-amino-1-propanol. Human exposure is preferably limited.

(d) Detergent Builder

An optional ingredient, but one that is highly preferred for concentrated compositions that are intended to be diluted, is from 0% to about 30%, preferably from about 0.1% to about 15%, more preferably from about 0.1% to about 12%, of detergent builder (relatively strong chelating agents). For use on glass and/or other shiny surfaces, a level of builder of from about 0.1% to about 0.5%, preferably from about 0.1% to about 1.2%, is useful. While any of the builders or inorganic salts can be used herein, some examples of builders for use herein are sodium nitrilotriacetate, potassium pyrophosphate, potassium tripolyphosphate, sodium or potassium ethane-1-hydroxyl-1,1-diphosphonate, the non-phosphorous chelating agents described in the copending U.S. patent application of Culshaw and Vos, Ser. No. 07/587,477, filed Sep. 19, 1990, said application being incorporated herein by reference (e.g., carboxymethyltartronic acid, oxydimalonic acid, tartrate monosuccinic acid, oxydisuccinic acid, tartrate disuccinic acid, and mixtures thereof), sodium citrate, sodium carbonate, sodium sulfite, sodium bicarbonate, and so forth. Preferred are mixtures of tartrate mono- and di- succinic acid salts in weight ratios of from about 70:30 to about 90:10 (TM/DS) and oxydisuccinic acid salts.

Other suitable builders are disclosed in U.S. Pat. No. 4,769,172, Siklosi, issued Sep. 6, 1988, and incorporated herein by reference, and chelating agents having the formula:

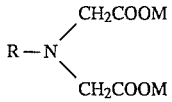

wherein R is selected from the group consisting of: $-CH_2CH_2CH_2OH$; $-CH_2CH(OH)CH_3$; $-CH_2CH(OH)CH_2OH$; $-CH(CH_2OH)_2$; $-CH_3$; $-CH_2CH_2OCH_3$;

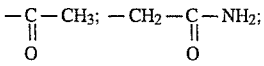

$-CH_2CH_2CH_2OCH_3$; $-C(CH_2OH)_3$; and mixtures thereof; and each M is hydrogen or an alkali metal ion.

Chemical names of the acid form of some chelating agents useful herein include:

N(3-hydroxypropyl)imino-N,N-diacetic acid (3-HPIDA);

N(-2-hydroxypropyl)imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilotriacetic, SAND);

acetamidoiminodiacetic acid (AIDA);

3-methoxypropylimino-N,N-diacetic acid (MEPIDA); and tris(hydroxymethyl)methylimino-N,N-diacetic acid (TRIDA).

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93–103 (1980), Mayer, Riecanska et al., publication of Mar. 26, 1979, for GLIDA;

C.A. 104(6)45062 d for MIDA; and

Biochemistry 5, p. 467 (1966) for AIDA.

Another type of builder/chelator suitable for use herein is polyacrylate, i.e., salts of relatively low molecular weight polyacrylic acid which has an average molecular weight of from about 1,000 to about 20,000 and which is at least partially neutralized with alkali metal, ammonium or substituted ammonium (e.g., mono-, di-, or triethanol-ammonium). Preferred average molecular weights are in the range of from about 1,000 to about 15,000, more preferably from about 2,000 to about 8,000, and preferred neutralizing ions are the alkali metals, especially sodium. A particularly preferred material is sodium neutralized polyacrylate having an average molecular weight of about 2,000.

The term "polyacrylates" herein also includes copolymers wherein acrylic acid has been copolymerized with small amounts of other monomers. The percentage by weight of the polyacrylate units which is derived from acrylic acid should be greater than about 80%. Suitable polymerizable monomers include, for example, methacrylic acid, hydroxyacrylic acid, vinyl chloride, vinyl alcohol, furan acrylonitrite, vinyl acetate, methyl acrylate, methyl methacrylate, styrene, vinyl methyl ether, acrylamide, ethylene, propylene and 3-butenoic acid, or mixtures thereof.

The levels of builder present in the wash solution used for glass should be less than about 0.4%, preferably less than about 0.25%. Therefore, dilution is highly preferred for cleaning glass, while full strength use is preferred for general purpose cleaning.

Other effective detergent builders, e.g., sodium citrate, sodium ethylenediaminetetraacetate, etc., can also be used, preferably at lower levels, e.g., from about 0.1% to about 1%, preferably from about 0.1% to about 0.5%.

Inclusion of a detergent builder improves cleaning. Except in the case of certain preferred builders discussed hereinafter, builders generally harm spotting and filming and their use is usually considered as a compromise in favor of cleaning. Inclusion of a detergent builder is optional for compositions that are to be used as is, and low levels are usually more preferred than high levels.

Concentrated cleaning solutions that are designed to be diluted with tap water at the point of use possess significant advantages over ready-to-use cleaning solutions. They are typically less expensive to make, because they require smaller manufacturing facilities and less packaging material. They are less expensive to ship, since the manufacturer does not have to pay for shipping water. They require less space to store before use, and impose a lower burden on landfill operations, since each case of concentrate can produce several cases of ready-to-use product upon dilution with water.

In the formulation of concentrates of the compositions herein, it is important to add chelating agents to prevent precipitation of mineral salts when the concentrate is diluted with tap water, especially for water having high hardness, e.g., about 10 grains, or higher.

The alkalinity of the cleaner described herein has a beneficial effect on its ability to effectively clean greasy surfaces, but also promotes the precipitation of salts, thought to be calcium and magnesium compounds, that form insoluble species in alkaline solutions with carbonates and other anionic species that are found in most tap water. This results, over time, in the formation of crystalline and/or flocculent precipitates, which settle to the bottom of the container. These precipitates are aesthetically unpleasing, and could result in the user discarding the cleaner because of its appearance, thereby causing product waste. More importantly, when these precipitates settle to the bottom of spray bottles of the type commonly used to dispense products for glass and hard-surface cleaning, they are likely to be pulled up into the spray nozzle and cause it to clog. This is a very significant functional disadvantage. For example, a sample of a cleaner from concentrate of the present invention but not containing a chelate was prepared by diluting the concentrate with tap water of approximately 16 grains of hardness per gallon. The sample sat for several days, during which a white precipitate formed which settled to the bottom of the container. When an attempt to use this bottle was made, the spray nozzle plugged up after 5–6 pumps, resulting in poor distribution of cleaner (about 3 square inches of spray coverage from a spray distance of 7 inches on to the measuring surface) vs. the normal coverage of about 29 square inches when the same dispenser was used with a cleaner made from concentrate containing the chelant. Furthermore, the plugged nozzle only delivered about 25% of the liquid volume that the unplugged nozzle delivered. This plugging is a significant impediment to anyone conducting normal cleaning operations, and causes significant loss of time.

Unfortunately, many water-conditioning agents found in the literature leave noticeable streaks, smears, or crystalline deposits on windows and shiny surfaces when they dry. This results in a surface that appears dirty, and requires extra polishing after cleaning to assure a clean-looking surface.

In accordance with one aspect of the present invention, two chelants have been found which prevent the formation of precipitates which can clog dispensing devices and also do not lead to formation of significant streaks, smears or residues. They are: (a) mixtures of tartrate mono- and disuccinic acid salts in weight ratios of from about 70:30 to about 90:10 (TM/DS); and (b) polyacrylate, as disclosed hereinbefore.

(e) The Aqueous Solvent System

The balance of the formula is typically water and non-aqueous polar solvents with only minimal cleaning action like methanol, ethanol, isopropanol, ethylene glycol, propylene glycol, and mixtures thereof. The level of non-aqueous polar solvent is usually greater when more concentrated formulas are prepared. Typically, in usage strength formulas, the level of non-aqueous polar solvent is from about 0.5% to about 40%, preferably from about 1% to about 10% and the level of water is from about 50% to about 99%, preferably from about 75% to about 95%.

Optional Ingredients

The compositions herein can also contain other various adjuncts which are known to the art for detergent compositions. Preferably they are not used at levels that cause unacceptable spotting/filming. Nonlimiting examples of such adjuncts are:

Cosolvents;

Cobuffer/alkalinity sources;

Nonionic detergent surfactants;

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Non-cationic antibacterial agents can be present, but preferably only at low levels to avoid spotting/filming problems. More hydrophobic antibacterial/germicidal agents, like orthobenzylpara-chlorophenol, are avoided. If present, such materials should be kept at levels below about 0. 1%.

The Cosolvent

In order to obtain good cleaning one can use a cosolvent that has cleaning activity in addition to the monoethanolamine and/or beta-aminoalkanol. The cosolvents employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula $$\gamma H = \gamma T\left[\frac{\alpha - 1}{\alpha}\right]^{1/2}$$

wherein YH is the hydrogen bonding parameter, $\alpha$ is the aggregation number, $$\left(\text{Log}\,\alpha = 3.39066\, T_b/T_c - 0.15848 - \text{Log}\frac{M}{d}\right), \text{ and}$$

YT is the solubility parameter which is obtained from the formula $$\gamma T = \left[\frac{(H_{25} - RT)d}{M}\right]^{1/2}$$

where $\Delta H_{25}$ is the heat of vaporization at 25° C., R is the gas constant (1.987 cal/mole/deg), T is the absolute temperature in °K., $T_b$ is the boiling point in °K., $T_c$ is the critical temperature in °K., d is the density in g/ml, and M is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Cosolvents are typically used at a level of from about 1% to about 30%, preferably from about 2% to about 15%, more preferably from about 4% to about 8%. Dilute compositions typically have cosolvents at a level of from about 1% to about 10%, preferably from about 3% to about 6%. Concentrated compositions contain from about 10% to about 30%, preferably from about 10% to about 20% of cosolvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^6O\text{-}(R^7O\text{-})_mH$ wherein each $R^6$ is an alkyl group which contains from about 3 to about 8 carbon atoms, each $R^7$ is either ethylene or propylene, and m is a number from 1 to about 3. The most preferred glycol ethers are selected from the group consisting of monopropyleneglycolmonopropyl ether, dipropyleneglycolmonobutyl ether, monopropyleneglycolmonobutyl ether, diethyleneglycolmonohexyl ether, monoethyleneglycolmonohexyl ether, monoethyleneglycolmonobutyl ether, and mixtures thereof. An especially preferred solvent is described in U.S. Pat. No. 4,943,392, Hastedt et al., issued Jul. 24, 1990, said patent being incorporated herein by reference.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents and their solubilities in water are shown in Table 1.

TABLE 1

Solubility of Selected Diols in 20° C. Water

| Diol | Solubility (g/100 g $H_2O$ |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements.
All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Solvents such as pine oil, orange terpene, benzyl alcohol, n-hexanol, phthalic acid esters of $C_{1-4}$ alcohols, butoxy propanol, Butyl Carbitol® and 1(2-n-butoxy-1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

The Cobuffer/Alkalinity-Sources

The compositions are formulated to have a pH, at least initially, in use of from about 9.5 to about 13, preferably from about 9.7 to about 12, more preferably from about 9.7 to about 11.5. pH is usually measured on the product. Additional buffering materials, in addition to the monoethanolamine and/or beta-aminoalkanol, include cobuffer and/or alkaline material selected from the group consisting of: ammonia; other $C_2$–$C_4$ alkanolamines; alkali metal hydroxides; silicates; borates; carbonates; and/or bicarbonates; and mixtures thereof. The preferred cobuffering/alkalinity materials are alkali metal hydroxides. The level of this additional cobuffer/alkalinity-source is from 0% to about 5%, preferably from 0% to about 5%. As discussed hereinbefore, monoethanolamine and/or beta-aminoalkanol buffering material, are essential in the system to provide the surprising improvement in spotting/filming, when used with the zwitterionic and cationic detergent surfactants.

The Nonionic Detergent Surfactants

The patents and references disclosed hereinbefore and incorporated by reference also disclose nonionic detergent surfactants, that can be used in small amounts in the composition of this invention as cosurfactants. Typical of these are the alkoxylated (especially ethoxylated) alcohols and alkyl phenols and the like, which are well known from the detergency art.

Some suitable nonionic surfactants for use in such cleaners are one or more of the following: the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide, especially one having the preferred formula:

$$R^1-\overset{\overset{\displaystyle O}{\|}}{C}-N(R^2)_2$$

wherein $R^1$ is a straight-chain alkyl group containing from about 7 to about 17, preferably from about 9 to about 13, carbon atoms and having an average carbon chain length of from about 9 to about 13 carbon atoms and wherein each $R^2$ is either an alkyl, or a hydroxy alkyl group, containing from 1 to about 3 carbon atoms.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. It is a special advantage of this invention that perfume ingredients, and especially natural oils and hard to solubilize components of natural oils, are readily solubilized in the compositions by the mixture of detergent surfactants. When common anionic detergent surfactants are substituted for the cationic detergent surfactant, the compositions will not solubilize as much perfume, especially substantive perfume, and especially natural oils and hard to solubilize components thereof, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Normally, the art recognized perfume compositions are not very substantive as described hereinafter to minimize their effect on hard surfaces.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal ol factory acuity. Such materials typically have vapor pressures lower than that of the average perfume material. Also, they typically have molecular weights of about 200 or above, and are detectable at levels below those of the average perfume material.

Perfumes can also be classified according to their volatility, as mentioned hereinbefore. The highly volatile, low boiling, perfume ingredients typically have boiling points of about 250° C. or lower. Many of the more moderately volatile perfume ingredients are also lost substantially in the cleaning process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be substantive, is lost during the cleaning cycle, and it is desirable to have means to retain more of these ingredients on the dry surfaces. Many of the perfume ingredients, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alphapinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8,-hexamethyl-cyclopentagamma-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate. These perfume ingredients are difficult to solubilize and thus especially demonstrate the improvement herein.

Selection of any particular perfume ingredient is primarily dictated by aesthetic considerations, but more water-soluble materials are preferred, as stated hereinbefore, since such materials are less likely to adversely affect the good spotting/filming properties of the compositions. If the terpene types of perfume ingredients are used, the betaoaminoalkanols are preferred for product stability.

These compositions have exceptionally good cleaning properties. They can also be formulated to have good "shine" properties, i.e., when used to clean glossy surfaces, without rinsing.

The compositions can be formulated to be used at full strength, where the product is sprayed onto the surface to be cleaned and then wiped off with a suitable material like cloth, a paper towel, etc. The compositions can also be formualated in concentrated form that is diluted before use. They can be packaged in a package that comprises a means for creating a spray, e.g. , a pump, aerosol propellant and spray valve, etc.

The invention is illustrated by the following Examples.

EXAMPLE I

| Ingredient | Formula No.* (Wt. %) | | | |
|---|---|---|---|---|
| | 1 | 2 | 3 | 4 |
| Propylene glycol mono-butylether | 2.0 | 2.0 | 2.0 | 2.0 |
| Isopropanol | 5.0 | 5.0 | 5.0 | 5.0 |
| Cocoamidopropyl (hydroxy-propyl)sulfobetaine | 0.15 | 0.15 | 0.15 | 0.15 |
| $C_{12-14}$ alkyl dimethyl ethyl benzyl ammonium chloride | 0.02 | 0.02 | 0.02 | 0.02 |
| Monoethanolamine | 1.0 | — | — | — |
| 1-amino-2-propanol | — | 1.0 | — | — |
| 2-amino-1-butanol | — | — | 1.0 | — |
| 2-amino-2-methyl-1-butanol | — | — | — | 1.0 |
| Perfume | 0.20 | 0.20 | 0.20 | 0.20 |
| Deionized water | q.s. 100 | | | |

*pH adjusted to about 11.3

EXAMPLE II

| Ingredient | Formula No.* (Wt. %) | | |
|---|---|---|---|
| | 1 | 2 | 3 |
| Lauryl-dimethyl-3-sulfopropylbetaine | 0.20 | — | — |
| Cocoyl-dimethyl-2-hydroxy-3-sulfopropylbetaine | — | 0.20 | — |
| Lauryl-dimethyl-betaine | — | — | 0.20 |
| $C_{12-18}$ alkyldimethylbenzyl ammonium chloride | 0.02 | 0.02 | 0.02 |
| 2-Amino-2-methyl-1-propanol | — | — | — |
| Monoethanolamine | 0.5 | 0.5 | 0.5 |
| Propylene glycol mono-butylether | 3.0 | 3.0 | 3.0 |
| Isopropanol | 3.0 | 3.0 | 3.0 |
| Deionized water and minors (e.g., perfume) | q.s. 100 | | |

-continued

| Ingredient | Formula No.* (Wt. %) | | |
|---|---|---|---|
| | 4 | 5 | 6 |
| Cocoamidipropyl-dimethyl-betaine | 0.20 | — | — |
| Cocoamidopropyl-dimethyl-2-hydroxy-3-sulfopropylbetaine | — | 0.20 | 0.18 |
| $C_{12-18}$ alkyldimethylbenzyl ammonium chloride | 0.02 | 0.02 | 0.02 |
| 2-Amino-2-methyl-1-propanol | — | — | — |
| Monoethanolamine | 0.5 | 0.5 | 0.5 |
| Propylene glycol mono-butylether | 3.0 | 3.0 | 3.0 |
| Isopropanol | 3.0 | 3.0 | 3.0 |
| Deionized water and minors (e.g., perfume) | q.s. 100 | | |

| Ingredient | Formula No.* (Wt. %) | | |
|---|---|---|---|
| | 7 | 8 | 9 |
| Cocoamidipropyl-dimethyl-betaine | 0.15 | 0.18 | 0.15 |
| $C_{12-18}$ alkyldimethylbenzyl ammonium chloride | 0.02 | 0.02 | 0.02 |
| 2-amino-2-methyl-1-propanol | 0.5 | — | — |
| Monoethanolamine | — | 0.5 | 0.5 |
| Propylene glycol mono-butylether | 3.0 | 4.0 | — |
| Ethylene glycol monobutylether | — | — | 3.0 |
| Isopropanol | 3.0 | 2.0 | 3.0 |
| Deionized water and minors (e.g., perfume) | q.s. 100 | | |

| Ingredient | Formula No.* (Wt. %) | | |
|---|---|---|---|
| | 10 | 11 | 12 |
| Cocoamidopropyl-dimethyl-2-hydroxy-3-sulfopropylbetaine | 0.19 | 0.15 | 0.18 |
| $C_{12-18}$ alkyldimethylbenzyl ammonium chloride | 0.02 | 0.02 | 0.02 |
| 2-amino-2-methyl-1-propanol | 0.5 | — | 1.0 |
| Monoethanolamine | — | 0.5 | — |
| Propylene glycol mono-butylether | 4.0 | — | 3.0 |
| Ethylene glycol monobutylether | — | 3.0 | — |
| Isopropanol | 2.0 | 3.0 | 3.0 |
| Deionized water and minors (e.g., perfume) | q.s. 100 | | |

*All pH's adjusted to about 10.9

The following example shows the Filming/Streaking performance for various formulations including the preferred zwitterionic/cationic/alkanolamine combinations.

EXAMPLE III

| Ingredient | Formula No.* (Wt. %) | |
|---|---|---|
| | 1 | 2 |
| Cocoamidopropyl (hydroxy- | 0.16 | 0.16 |

-continued

| Ingredient | Formula No.* (Wt. %) 1 | 2 |
|---|---|---|
| propyl)sulfobetaine | | |
| Sodium alkyl sulfate (~$C_{13}$) | 0.02 | — |
| Alkyl ($C_{12-18}$) dimethyl benzyl ammonium chloride | — | 0.02 |
| Propylene glycol monobutylether | 3.0 | 3.0 |
| Isopropanol | 2.0 | 2.0 |
| Monoethanolamine | 0.5 | 0.5 |
| Perfume | 0.5 | 0.5 |
| Deionized water | q.s. 100 | |

*pH adjusted to 10.5 with NaOH.

In Example III, the following test was used to evaluate the products' performance.

Filming/Streaking Stress Test

Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading by expert judges.

Grading:

Three expert graders are employed to evaluate the specific areas of product application for amount of filming/streaking. A numerical value describing the amount of filming/streaking is assigned to each product. For the test results reported here a 0–10 scale was used.

0=No Filming/Streaking

10=Poor Filming/Streaking

Room temperature ad humidity have been shown to influence filming/streaking. Therefore these variables are always recorded.

Filming/Streaking Stress Test on Glass Windows (Four Replications at 73° F. and 18% Relative Humidity)

| Formula No. | Mean Rating |
|---|---|
| 1 | 3.6 |
| 2 | 1.1 |

The least significant difference between mean ratings is 0.6 at 95% confidence level. Formula No. 2 is clearly superior to Formula No. 1 in this test.

Perfume Solubilization Capacity

After 40 minutes of mixing with 0.05% perfume containing hard to solubilize components, e.g., from natural oils, Formula No. 1 is still slightly opaque, whereas Formula No. 2 under the same mixing conditions was completely clear in less than 2 minutes. This clearly shows the greater capacity for solubilizing perfume that is inherent in Formula No. 2.

EXAMPLE IV

Single-Strength Disinfectant

| Component | Wt. % |
|---|---|
| Isopropanol | 6.0 |
| Propylene glycol monobutyl ether | 3.0 |
| Varion CAS* | 0.16 (100% active basis) |
| Monoethanolamine | 0.5 |
| Maquat MQ 2525M** | 0.1 (100% active basis) |
| Distilled water | 90.2 |

*Cocoamidopropyl (hydroxypropyl)sulfobetaine (sold on 40% active basis, by Sherex Chemical Co.).
**50/50 mixture of $C_{12}$–$C_{14}$ dimethyl ethyl benzyl ammonium chloride and $C_{12}$–$C_{18}$ alkyl dimethyl benzyl ammonium chloride (sold on 80% active basis, by Mason Chemical Co.)

EXAMPLE V

Disinfectant Concentrate

| Component | Wt. % |
|---|---|
| Isopropanol | 14.4 |
| Propylene glycol monobutyl ether | 13.2 |
| FMB 3328* | 1.0 (100% active basis) |
| Varion CAS** | 0.8 (100% active basis) |
| 2-Amino, 2-methyl propanol | 1.50 |
| Polyacrylate*** | 0.22 (100% active basis) |
| Distilled/soft water (with touch of blue dye included) | 68.9 |

*50/50 mixture Of $C_{12}$–$C_{14}$ alkyl dimethyl ethyl benzyl ammonium chloride and $C_{12}$–$C_{18}$ alkyl dimethyl benzyl ammonium chloride (80% active basis) sold by Huntington Laboratories.
**Cocoamidopropyl (hydroxypropyl)sulfobetaine (sold on 40% active basis, by Sherex Chemical Co.).
***Acusol 445N - Neutralized polyacrylic acid having an average molecular weight of 4500, sold by Rohm and Haas Co., as 45% aqueous solution.

EXAMPLE VI

Concentrated Glass and Multi-Surface Cleaner

| Component | Wt. % |
|---|---|
| Isopropanol | 19.0 |
| Propylene glycol monobutyl ether | 10.0 |
| Varion CAS* | 0.8 (100% active basis) |
| Maquat MQ 2525M** | 0.1 (100% active basis) |
| Monoethanolamine | 1.25 |
| Polyacrylate*** | 0.18 (100% active basis) |
| Distilled/soft water | 68.7 |

*Cocoamidopropyl (hydroxypropyl)sulfobetaine (sold on 40% active basis, by Sherex Chemical Co.).
**50/50 mixture of $C_{12}$–$C_{14}$ dimethyl ethyl benzyl ammonium chloride and $C_{12}$–$C_{18}$ alkyl dimethyl benzyl ammonium chloride (sold on 807, active basis, by Mason Chemical Co.)
***Acusol 445N - Neutralized polyacrylic acid having an average molecular weight of 4500, sold by Rohm and Haas Co., as 45% aqueous solution.

What is claimed is:

1. An aqueous liquid hard surface detergent composition suitable for use on glass comprising: detergent surfactant consisting essentially of a mixture of (a) from about 0.001% to about 15% zwitterionic detergent surfactant and (b) from about 0.02% to about 2% cationic detergent surfactant; (c) from about 0.5% to about 10% of compound selected from the group consisting of: monoethanolamine, beta-aminoalkanol containing from three to about six carbon atoms, 3-amino-1-propanol, and mixtures thereof; and the balance being (d) an aqueous solvent system comprising water and, optionally, non-aqueous polar solvent with only minimal cleaning action selected from the group consisting of: methanol, ethanol, isopropanol, ethylene glycol, propylene glycol, and mixtures thereof and (e) any optional minor ingredients said composition being substantially free of orthobenzyl-para-chlorophenol and containing less than about 0.4% detergent builder/chelating agent.

2. The composition of claim 1 wherein (c) is 2-amino,2-methyl propanol.

3. The composition of claim 2 wherein the anionic group in said zwitterionic detergent surfactant (a) is a sulfonate group and (c) is present at a level of from about 0.001% to about 15%.

4. The composition of claim 3 wherein said detergent surfactant (a) comprises from about 0.02% to about 10% hydrocarbyl-amidoalkylenesulfobetaine which has the formula:

$$R^3—C(O)—N(R^4)—(CR^5{}_2)_n—N(R^6)_2(+)—(CR^5{}_2)_p—SO_3\ (-)$$

wherein each $R^3$ is an alkyl, or alkylene, group containing from about 10 to about 18 carbon atoms, each ($R^4$) and $R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

5. The composition of claim 2 wherein said detergent surfactant (a) comprises from about 0.001% to about 15% hydrocarbyl-amidoalkylenebetaine which has the formula:

$$R^3—C(O)—N(R^4)—(CR^5{}_2)_n—N(R^6)_2(+)—(CR^5{}_2)_n—COO(-)$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

6. The composition of claim 1 comprising: (a) from about 0.02% to about 10% zwitterionic detergent surfactant; (b) from about 0.1% to about 2% cationic detergent surfactant; (c) from about 0.5% to about 10% of compound selected from: monoethanolamine, beta-aminoalkanol containing from three to about six carbon atoms, and mixtures thereof; (d) an aqueous solvent system comprising water and, optionally, non-aqueous polar solvent with only minimal cleaning action selected from the group consisting of: methanol, ethanol, isopropanol, ethylene glycol, propylene glycol, and mixtures thereof and (e) any optional minor ingredients said composition being substantially free of orthobenzylpara-chlorophenol, anionic detergent surfactant, and crystallizable salts that cause spotting filming.

7. The composition of claim 1 wherein said detergent surfactant (a) comprises from about 0.001% to about 15% zwitterionic detergent surfactant which has the formula:

$$R^3—[C(O)—N(R^4)—(CR^5{}_2)_n—]_m N(R^6)_2(+)—(CR^5{}_2)_p—Y(-)$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any ($CR^5{}_2$) moiety; m is 0 or 1; each n and p is a number from 1 to about 4; and each Y is either a carboxylate or sulfonate group.

8. The composition of claim 7 wherein y is a sulfonate group, said $R^3$ group contains from about 9 to about 15 carbon atoms, $R^4$ is hydrogen, each $R^6$ is methyl, one of the $R^5$ groups between the (+) and the (–) charge centers is a hydroxy group and the remaining $R^5$ groups are hydrogen, and each n and p is 3.

9. The composition of claim 7 containing from about 0.02% to about 2% of cationic detergent surfactant.

10. The composition of claim 1 wherein said detergent surfactant (a) comprises from about 0.02% to about 10% hydrocarbyl-amidoalkylenebetaine which has the formula:

$$R^3—C(O)—N(R^4)—(CR^5{}_2)_n—N(R^6)_2(+)—(CR^5{}_2)_p—COO(-)$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

11. The composition of claim 1 having an initial pH in use of from about 9.5 to about 13.

12. The composition of claim 11 wherein said pH is from about 9.7 to about 12.

13. The composition of claim 1 wherein there is sufficient alkali metal hydroxide to give a pH of from about 9.7 to about 11.3.

14. The composition of claim 1 wherein said cationic detergent surfactant has disinfectant properties.

15. The composition of claim 1 wherein said cationic surfactant is selected from the group consisting of: $C_{12-18}$ alkyl benzyl dimethyl ammonium chloride; $C_{12-14}$ alkyl dimethyl ethylbenzyl ammonium chloride; di-$C_{8-10}$ alkyl dimethyl ammonium chloride; and mixtures thereof.

16. The composition of claim 15 wherein (c) is monoethanolamine.

17. The composition of claim 16 wherein the anionic group in said zwitterionic detergent surfactant (a) is a sulfonate and (a) is present at a level of from about 0.001% to about 15%.

18. The composition of claim 17 wherein said detergent surfactant (a) comprises from about 0.02% to about 10% hydrocarbyl-amidoalkylenesulfobetaine which has the formula:

$$R^3—C(O)—N(R^4)—(CR^5{}_2)_n—N(R^6)_2(+)—(CR^5{}_2)_p—SO_3\ (-)$$

wherein each $R^3$ is an alkyl, or alkylene, group containing from about 10 to about 18 carbon atoms, each ($R^4$) and $R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

19. The composition of claim 15 containing, as an additional ingredient, a solubilized perfume at a level that would not be solubilized by the zwitterionic detergent surfactant alone.

20. The composition of claim 19 wherein said detergent surfactant (a) comprises from about 0.001% to about 15% zwitterionic detergent surfactant which has the formula:

$R^3—[C(O)—N(R^4)—(CR^5{}_2)_n—]_mN(R^6)_2(+)—(CR^5{}_2)_p—Y(-)$ wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any ($CR^5{}_2$) moiety; m is 0 or 1; each n and p is a number from 1 to about 4; and each Y is either a carboxylate or a sulfonate group.

21. An aqueous liquid hard surface detergent composition comprising: (a) from about 0.02% to about 10% zwitterionic detergent surfactant; (b) from about 0.1% to about 2% cationic detergent surfactant; (c) from about 0.5% to about 10% of compound selected from: monoethanolamine, beta-aminoalkanol containing from three to about six carbon atoms, and mixtures thereof; (d) from about 0.1% to about 0.4% detergent builder/chelating agent; and the balance being (e) an aqueous solvent system comprising water and, optionally, non-aqueous polar solvent with only minimal cleaning action selected from the group consisting of: methanol, ethanol, isopropanol, ethylene glycol, propylene glycol, and mixtures thereof and (f) any optional minor ingredients said composition being substantially free of orthobenzyl-para-chlorophenol.

22. The composition of claim 21 wherein (c) is monoethanolamine.

23. The composition of claim 21 wherein the anionic group in said zwitterionic detergent surfactant (a) is a sulfonate group and the levels of (a), (b), (c), and (d) are: (a) from about 0.2% to about 10%; (b) from about 0.1% to about 1.5%; (c) from about 1% to about 5%; (d) from about 0.1% to about 12%.

24. The composition of claim 23 wherein said detergent surfactant (a) comprises from about 0.03% to about 5% hydrocarbyl-amidoalkylenesulfobetaine which has the formula:

$R^3—C(O)—N(R^4)—(CR^5{}_2)_n—N(R^6)_2(+)—(CR^5{}_2)_p—SO_3\ (-)$ wherein each $R^3$ is an alkyl, or alkylene, group containing from about 10 to about 18 carbon atoms, each ($R^4$) and $R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

25. The composition of claim 21 wherein the detergent builder (d) is selected from the group consisting of: (1) mixtures of tartrate mono- and di- succinic acid salts in weight ratios of from about 70:30 to about 90:10; (2) salts of polyacrylic acid having an average molecular weight between about 1,000 and about 20,000; and (3) mixtures thereof.

26. The composition of claim 25 wherein the detergent builder is (2) salts of polyacrylic acid having an average molecular weight between about 1,000 and about 20,000.

27. The composition of claim 1 containing, as an additional ingredient, a solubilized perfume at a level that would not be solubilized by the zwitterionic detergent surfactant alone.

28. The composition of claim 27 wherein said perfume comprises components of natural oils selected from the group consisting of: benzophenone, benzyl salicylate, ethylene brassylate, galaxolide (1,3,4,6,7,8-hexahydro-4,6,6,7,8,8-hexamethyl-cyclopenta-gamma-2-benzopyran), hexyl cinnamic aldehyde, lyral (4-(4-hydroxy-4-methylpentyl )-3-cyclohexene-10-carboxaldehyde), methyl cedrylone, methyl dihydro jasmonate, methyl-beta-naphthyl ketone, musk indanone, musk ketone, musk tibetene, phenylethyl phenyl acetate, and mixtures thereof.

29. The composition of claim 27 wherein said perfume consists essentially of components having boiling points above about 300° C.

* * * * *